US006050616A

United States Patent [19]

Evans

[11] Patent Number: 6,050,616

[45] **Date of Patent: *Apr. 18, 2000**

[54] CASE CATCHES

[75] Inventor: Norman Evans, Redditch, United Kingdom

[73] Assignee: Protex Fasteners Limited, Hereford, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/888,409

[22] Filed: Jul. 7, 1997

[30] Foreign Application Priority Data

Sep. 26, 1996 [GB] United Kingdom ..... 9620065

[51] Int. Cl.[7] ..... E05C 5/00

[52] U.S. Cl. ..... 292/111; 292/109

[58] Field of Search ..... 292/95, 111, 137, 292/140

[56] References Cited

U.S. PATENT DOCUMENTS

| | | | |
|---|---|---|---|
| 2,820,995 | 1/1958 | Schlueter | 292/111 |
| 2,853,751 | 9/1958 | Schlueter | 292/111 |
| 2,853,752 | 9/1958 | Schlueter | 292/111 |
| 3,150,893 | 9/1964 | Poe | 292/111 |
| 3,204,993 | 9/1965 | Swanson | 292/111 |
| 3,295,877 | 1/1967 | Swanson | 292/111 |
| 4,090,727 | 5/1978 | Busch et al. | 292/111 |
| 4,296,580 | 10/1981 | Weinar | 52/281 |
| 4,560,190 | 12/1985 | Werner | 292/111 |
| 4,746,151 | 5/1988 | Hoen et al. | 292/111 |
| 4,758,031 | 7/1988 | Wolf | 292/111 |
| 4,958,865 | 9/1990 | Cheng | 292/111 |
| 5,669,638 | 9/1997 | Anderson et al. | 292/111 |

FOREIGN PATENT DOCUMENTS

| | | | |
|---|---|---|---|
| 589601 | 12/1959 | Canada | 292/111 |

*Primary Examiner*—Teri Pham

*Attorney, Agent, or Firm*—Reising, Ethington, Barnes, Kisselle, Learman & McCulloch, P.C.

[57] ABSTRACT

The invention is concerned with case catches (FIG. 4) comprising a claw 40 which can be driven by a crank mechanism through a finger plate 12 so as to retract the claw towards the finger plate and draw two parts of the case together. The mechanism includes an intermediate plate 22 which is journalled for rotation within the thickness of the cover plate 10 and is trapped between the parts which are arranged to turn with the finger plate 12 (14,16,18,20) on one side, and the face plate 24 on the other side. The assembly is held together by the rivets 28, 30 and freedom for rotation is maintained when the riveting step is completed, despite the part 32 being of the same thickness of the part 10 and hence liable to be trapped between the rotating assembly on the one side and the plate 24 on the other side, by the provision of a swaged annular rib 32.

8 Claims, 3 Drawing Sheets

CASE CATCHES

This invention relates to case catches which essentially comprise a claw or hasp to be mounted on one part and which is axially movable to engage and draw a second part towards the first part of the case. The one part may be the major part of a case and the other part of a case may be its lid. A drive mechanism is provided to cause said movement, and the mechanism comprises an axially short post which is journalled for rotation on the first part and carries a crank or eccentric coupled to the claw, and has means to facilitate its rotation. The means may be a slotted head to be turned by a screwdriver or a coin in lieu, or may be a finger plate to facilitate manual manipulation without using a tool.

BACKGROUND OF THE INVENTION

Such case catches are well known. Hitherto, commercially successful designs have been manufactured from mild steel as a series of components, some of which are pressings and the post has been a turned part. For aesthetic and practical purposes the parts have been plated for example chromium plated. It is desirable to make the catches of stainless steel, but this has been found to be unexpectedly difficult in ordinary commercial quantities at economically acceptable prices due to difficulties in making turned parts from stainless steel, and to constraints in the availability of appropriately dimensioned material for the pressings. The object of the invention is to solve these problems.

According to the invention, a case catch comprises a drive mechanism including an axially short post made as a stack of sheet metal pressings including an intermediate pressing which lies in a journal aperture in the said one part and is sandwiched between a face plate and a locating plate which lie on opposite sides of the aperture, all of the parts of the stack being coupled together.

Preferably the coupling is a pair of rivets with axes located on a diameter of the parts and symmetrically of the axis of rotation. Conveniently one of the rivets mounts the crank where this is used.

One of the problems faced by the inventor is that stainless steel sheet for the pressings is made in a limited range of thicknesses, for example one millimeter, two millimeter and so on. To have sheet rolled to a different "special" thickness is uneconomic especially if it is wanted for a small component required in relatively small quantities. The said intermediate pressing used in the present invention is to lie in and be journalled for easy turning in an aperture in a hole in a different part, herein called the housing. To retain it in position it is sandwiched between the face plate and the locating plate which are also, in the invention, pressings which thus lie on opposite faces of the housing and these three (inter alia) are rivetted together. If the intermediate plate is made of the same thickness metal as the housing, the riveting will cause it to be too stiff for easy turning. If the intermediate plate is made of the next thicker grade of sheet metal available, it is likely to be too free in turning and be unsatisfactory for additional reasons. (In the case of a turned part it would obviously be possible to control the width of the groove which is equivalent to the thickness of the intermediate plate thus avoiding the problem). The inventor solves this difficulty by pressing a generally annular rib from the face of the intermediate plate so as to make it effectively axially thicker. The height of the rib can be easily controlled to give the required running clearance. Instead of using an annular rib, spaced dimples could produce a like effect.

The finger plate desirably folds flat when not in use, and is spring urged to either the flat or erect position. According to the invention this is achieved by making the finger plate as a pressing with axially aligned trunnion parts which have flat faces, and journalling the trunnions in the locating plate which may also be of a thinner material than the finger plate. Spring loading may be provided by a spring ring or Circlip (RTM) trapped in the cavity to overlie both trunnions, and held in place by a bridge plate extending transversely of an axis containing both trunnions. The bridge plate and locating plate may be held by the previously discussed rivets as part of the same assembly. When the finger plate is turned about the trunnions axis the flats, or their edges, deflect the spring at diametric positions, but the retention of the spring against deflection by the bridge plate creates a restoring force to return the finger plate or snap it to the next alternative position.

THE DRAWINGS

One embodiment of the invention is now more particularly described with reference the accompanying drawings wherein.

DETAILED DESCRIPTION

Figure 3:
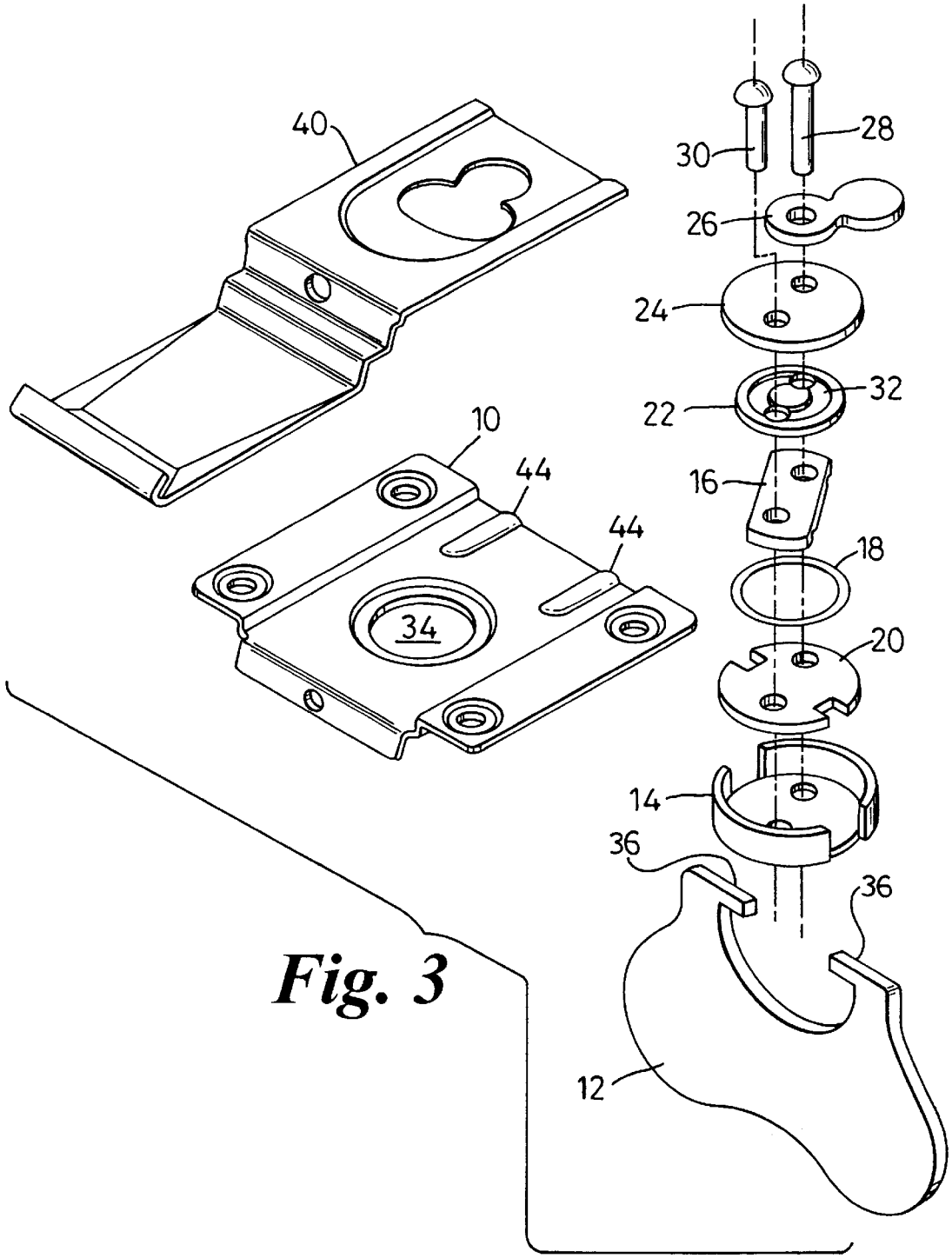
FIG. 3 is an exploded view showing the drive mechanism and other components.

Turning now to the drawings, it is convenient to start with FIG. 3 and name the parts. 10 is the housing, 12 is the finger plate, 14 is the cover plate of the driving mechanism, 16 is the bridge plate, 18 is the spring ring, 20 is the locating plate (for the finger plate) 22 is the intermediate plate, 24 is the face plate, 26 is the crank, and 28 and 30 are a pair of rivets of unequal length.

Figure 4:
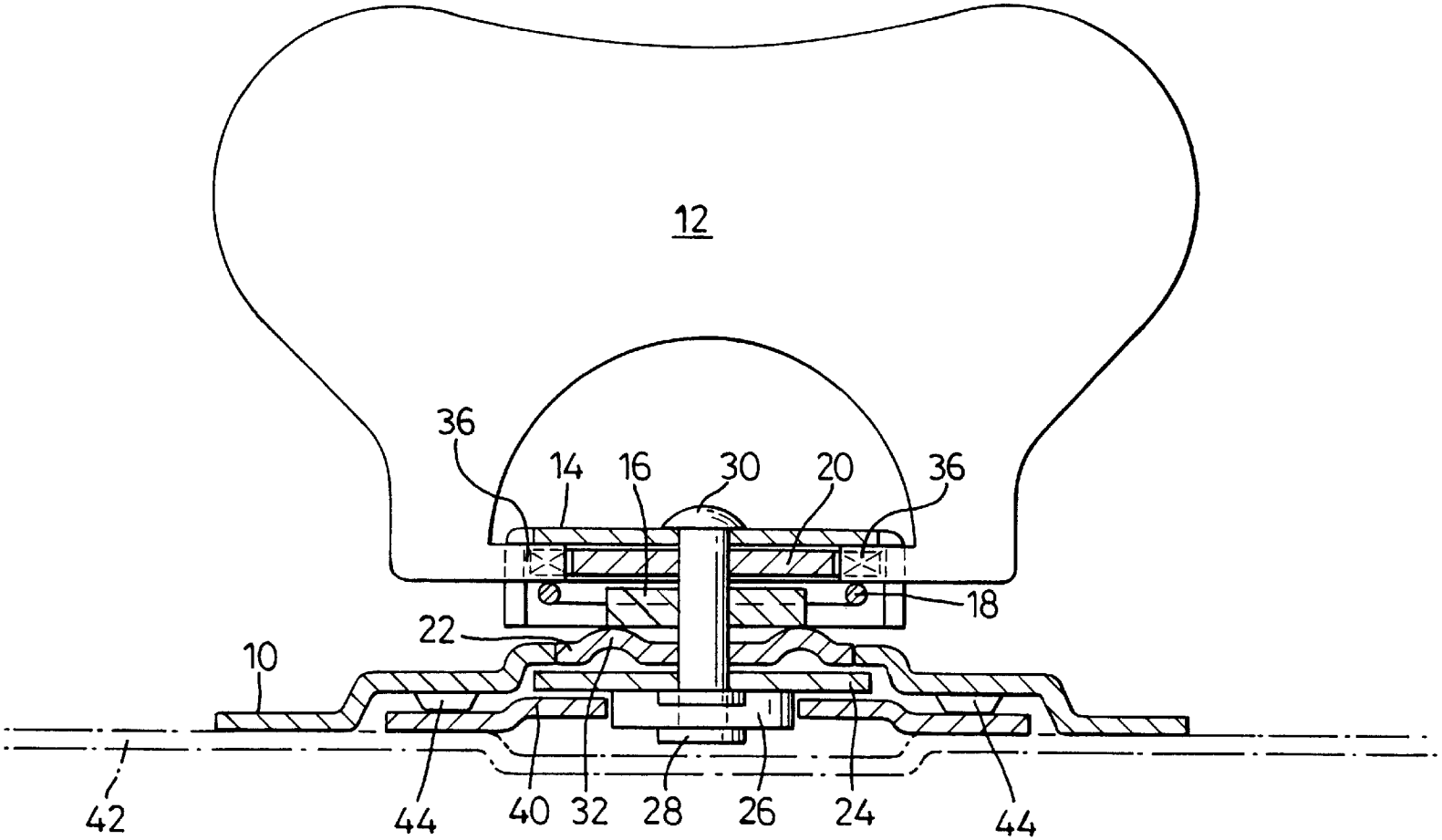
FIG. 4 is an enlarged sectional elevation taken on the line 4—4 of FIG. 1 (but with the finger plate in raised position) of the components of FIG. 3 assembled with clearances exaggerated.

These components are shown assembled in FIG. 4 with the intermediate plate 22, with its annular rib 32, made of a material of the same thickness as the housing 10, and journalled in aperture 34 in the housing. FIG. 4 also show the trunions (36) of the finger plate journaled in the locating plate.

In FIG. 4 it will be seen that the crank 26 lies in an aperture of appropriate shape in the claw 40.

Figure 1:
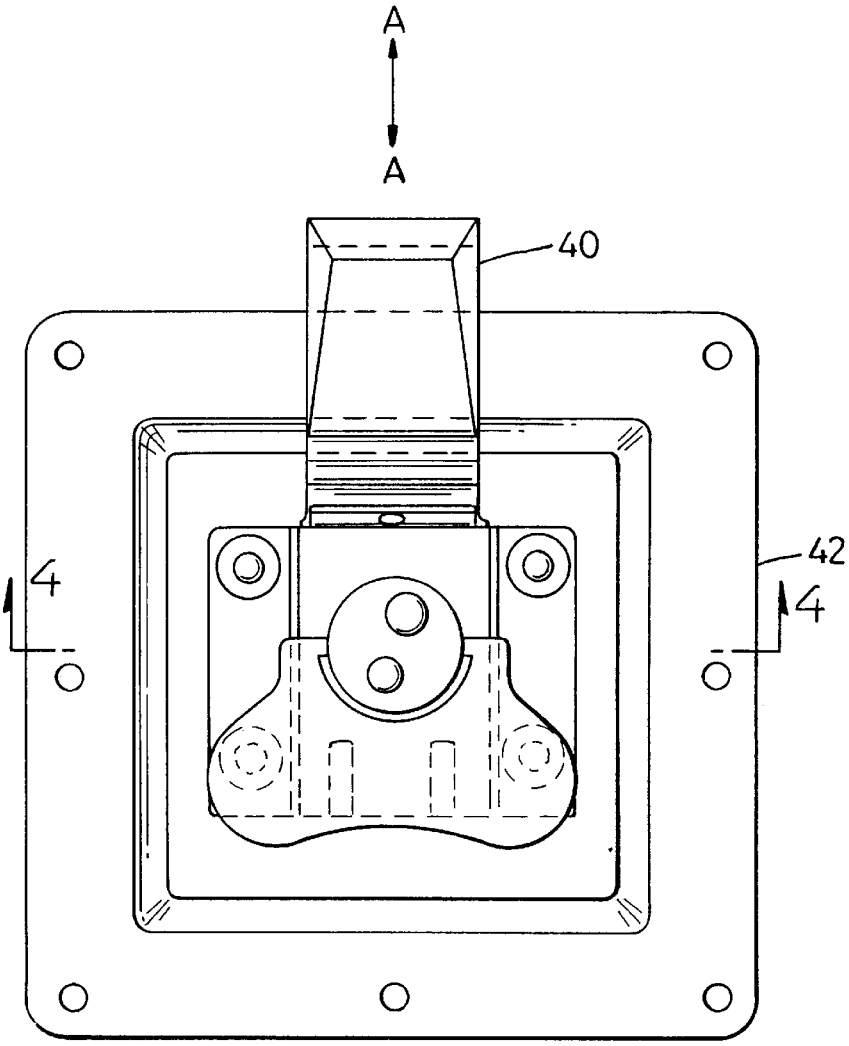
FIG. 1 is an elevation of case catch, omitting the keeper or other part which the claw is to engage when in use.
Figure 2:
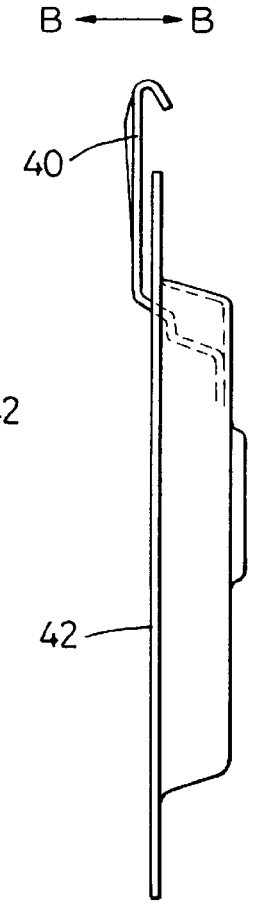
FIG. 2 is a side elevation of the catch as shown in FIG. 1.
Figure 5:
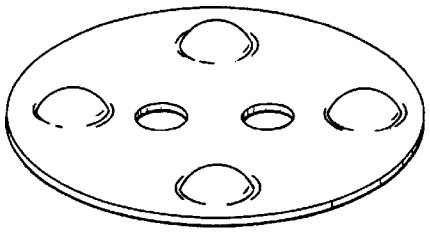
FIG. 5 is an isometric view of a modification.

FIGS. 1 and 2 show the assembly fixed in a mounting plate 42 which is generally square and which has a dished central area receiving the driving mechanism, and the claw extends, via a series of transverse cranks or steps, from the floor of the dished area over the rim of the plate 42. In movement in the direction of the arrows A—A FIG. 1, the claw is lifted, i.e. moved pr deflected in the direction of the arrows B—B FIG. 2 by means of the steps so as to clear the edge of a lid part to which a keeper is attached and at an appropriate point returned to the required plane for engagement with that keeper. This movement of the crank is facilitated by the ribs 44 in the housing which engage the trailing end of the claw at one axial position but release the claw for the required movement in the B—B direction once the axial movement has taken the trailing end of the claw past those ribs. Instead of deforming the intermediate plate 22 to produce the rib 32, it may be deformed to provide arcuately spaced apart dimples 46 (FIG. 5) which, like the rib 32, project beyond the plane of one face of the plate 22 to increase the effective thickness of such plate.

What is claimed is:

1. A case catch construction comprising a housing adapted for mounting on one part of a two part case, said housing having an aperture therein;

a claw movably accommodated in said housing; and a drive mechanism coupled to said claw for moving said claw relative to said housing between retracted and extended positions, said drive mechanism comprising an intermediate plate occupying and journaled in said aperture for rotation about an axis and sandwiched between a face plate and a locating plate, means coupling all of said plates together in a stack, said housing and said intermediate plate being formed from planer sheet material of uniform thickness but said intermediate plate having a portion thereof deformed out of the plane of said intermediate plate to produce an effective thickness of said intermediate plate greater than that of said housing and the others of said plates, thereby increasing the spacing between the face plate and the locating plate.

2. The construction according to claim 1 wherein the means coupling said plates in a stack comprises a pair of rivets having longitudinal axes located symmetrically on opposite sides of the axis of rotation of said intermediate plate.

3. The construction according to claim 1 wherein said portion of said intermediate plate comprises an arcuate rib.

4. The construction according to claim 1 wherein said portion of said intermediate plate comprises arcuately spaced dimples.

5. The construction according to claim 1 wherein said drive mechanism includes a finger plate journaled on said locating plate for rocking movements between flat and erect positions.

6. The construction according to claim 5 including spring means acting on said finger plate for yieldably retaining said finger plate in each of said positions.

7. The construction according to claim 5 wherein said finger plate has trunnion parts journaled in said locating plate, said trunnion parts being formed of material thicker than that forming said locating plate.

8. The construction according to claim 7 wherein said finger plate is yieldably maintained in either of said positions by a part overlying both of said trunnion parts and held in place by a bridge plate extending transversely of an axis containing both of said trunnion parts.

* * * * *

UNITED STATES PATENT AND TRADEMARK OFFICE

CERTIFICATE OF CORRECTION

PATENT NO. : 6,050,616
DATED : April 18, 2000
INVENTOR(S) : Norman Evans

It is certified that error appears in the above-identified patent and that said Letters Patent is hereby corrected as shown below: Title page, item [57], Substitute the following abstract for the abstract presently of record:

-- ABSTRACT

A case catch has a claw movable between retracted and extended positions via a drive mechanism operable in response to rotation of a finger plate. The drive mechanism includes an intermediate plate accommodated and journaled in an aperture in a housing on which the claw is supported and sandwiched between two other plates. The plates and the housing are formed from sheet material of uniform thickness, but the intermediate plate has portions thereof deformed out of its plane to increase its effective thickness and facilitate its rotation. --

Column 1, line 4, after "part" insert -- of a case --; line 6, before "towards" insert -- of the case --; same line, after "part" cancel "of the case"; line 7, after "part" cancel "of a case" (second occurrence);

UNITED STATES PATENT AND TRADEMARK OFFICE

CERTIFICATE OF CORRECTION

PATENT NO. : 6,050,616

DATED : April 18, 2000

INVENTOR(S) : Norman Evans

It is certified that error appears in the above-identified patent and that said Letters Patent is hereby corrected as shown below:

between lines 27 amd 28, insert the centered heading -- SUMMARY OF THE INVENTION --; line 41, change "millimeter" to -- millimetre -- (both occurrences).

Column 2, line 26, cancel "and" (second occurrence); line 30, after "exaggerated;" insert -- and --; line 56, change "pr" to -- or --.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*